US007097954B2

(12) United States Patent
Hawkins et al.

(10) Patent No.: US 7,097,954 B2
(45) Date of Patent: Aug. 29, 2006

(54) TONER PROCESSES

(75) Inventors: Michael S. Hawkins, Cambridge (CA); Vladislav Skorokhod, Mississauga (CA); Richard P. N. Veregin, Mississauga (CA); Jackie B. Parker, Mississauga (CA); Eric M. Strohm, Burlington (CA)

(73) Assignee: Xerox Corporation, Stamford, CT (US)

( * ) Notice: Subject to any disclaimer, the term of this patent is extended or adjusted under 35 U.S.C. 154(b) by 199 days.

(21) Appl. No.: 10/767,754

(22) Filed: Jan. 28, 2004

(65) Prior Publication Data

US 2005/0165132 A1 Jul. 28, 2005

(51) Int. Cl.
*G03G 5/00* (2006.01)

(52) U.S. Cl. ..... 430/137.14; 523/334

(58) Field of Classification Search ..... 430/137.14; 523/334

See application file for complete search history.

(56) References Cited

U.S. PATENT DOCUMENTS

| | | | | |
|---|---|---|---|---|
| 4,558,108 | A | 12/1985 | Alexandru et al. | 526/340 |
| 4,797,339 | A | 1/1989 | Maruyama et al. | 430/109 |
| 4,837,100 | A | 6/1989 | Murofushi et al. | 430/106.6 |
| 4,983,488 | A | 1/1991 | Tan et al. | 430/137 |
| 4,996,127 | A | 2/1991 | Hasegawa et al. | 430/109 |
| 5,278,020 | A | 1/1994 | Grushkin et al. | 430/137 |
| 5,290,654 | A | 3/1994 | Sacripante et al. | 430/137 |
| 5,308,734 | A | 5/1994 | Sacripante et al. | 430/137 |
| 5,536,615 | A | 7/1996 | Hopper et al. | |
| 5,593,807 | A | 1/1997 | Sacripante et al. | 430/137 |
| 5,604,076 | A | 2/1997 | Patel et al. | 430/137 |
| 5,648,193 | A | 7/1997 | Patel et al. | 430/137 |
| 5,658,704 | A | 8/1997 | Patel et al. | 430/137 |
| 5,660,965 | A | 8/1997 | Mychajlowskij et al. | 430/137 |
| 5,840,462 | A | 11/1998 | Foucher et al. | 430/137 |
| 5,843,614 | A | 12/1998 | Shinzo et al. | 430/137 |
| 5,853,944 | A | 12/1998 | Foucher et al. | 430/137 |
| 5,858,601 | A | 1/1999 | Ong et al. | 435/137 |
| 5,919,595 | A | 7/1999 | Mychajlowskij et al. | 430/137 |
| 5,925,488 | A | 7/1999 | Patel et al. | 430/137 |
| 5,945,245 | A | 8/1999 | Mychajlowskij et al. | 430/137 |
| 5,977,210 | A | 11/1999 | Patel et al. | 523/161 |
| 6,132,924 | A | 10/2000 | Patel et al. | 430/137 |
| 6,190,820 | B1 | 2/2001 | Patel et al. | |
| 6,395,445 | B1 | 5/2002 | Toth et al. | |
| 6,413,691 | B1 * | 7/2002 | Daimon et al. | 430/109.4 |
| 6,416,920 | B1 | 7/2002 | Hopper et al. | |
| 2003/0017406 | A1 * | 1/2003 | Gutman et al. | 430/108.3 |
| 2003/0027073 | A1 | 2/2003 | Manabu et al. | |
| 2003/0104296 | A1 | 6/2003 | Hamano et al. | |
| 2003/0175609 | A1 | 9/2003 | Combes et al. | |
| 2003/0219666 | A1 | 11/2003 | Kitani et al. | |

FOREIGN PATENT DOCUMENTS

| | | |
|---|---|---|
| EP | 1 441 260 | 7/2004 |
| WO | WO 03/087949 | 10/2003 |

OTHER PUBLICATIONS

Silence, Scott et al., U.S. Appl. No. 10/261,129, filed Sep. 27, 2002 on Toners and Developers.

Stegamat, Reza et al., U.S. Appl. No. 10/260,377, filed Sep. 27, 2002 on Toner Processes.

* cited by examiner

*Primary Examiner*—Mark A. Chapman

(74) *Attorney, Agent, or Firm*—Eugene O. Palazzo; Fay, Sharpe, Fagan, Minnich & McKee, LLP

(57) ABSTRACT

A toner process comprising heating a mixture of a latex and a colorant dispersion in the presence of an aggregating agent, and subsequently adding in an amount of at least about 4 weight percent alumina particles, and optionally which particles primarily function as a charge enhancing additive.

33 Claims, No Drawings

TONER PROCESSES

PENDING APPLICATIONS AND PATENTS

Illustrated in copending application U.S. Ser. No. 10/261,129 entitled Toners and Developers, filed Sep. 27, 2002, the disclosure of which is totally incorporated herein by reference, is a toner comprising at least one binder in an amount of from about 85 to about 99 percent by weight, at least one colorant in an amount of from about 0.5 to about 15 percent by weight, and calcium stearate in an amount of from about 0.05 to about 2 percent by weight, and wherein following triboelectric contact with carrier particles, the toner has a charge Q measured in femtocoulombs per particle diameter D measured in microns (Q/D) of from about −0.1 to about −1 fC/μm with a variation during development of from about 0 to about 0.25 fC/μm, and wherein the distribution is substantially unimodal and possesses a peak width of from about 0.1 fC/μm to about 0.5 fC/μm and the toner possesses a charge to mass M, as measured in grams, ratio (Q/M) of from about −25 to about −70 μC/gram with variation of Q/M during development of from about 0 to about 15 μC/gram.

Illustrated in copending application U.S. Ser. No. 10/086,063, entitled Toner Processes, filed Mar. 1, 2002, the disclosure of which is totally incorporated herein by reference, is a process comprising heating a latex, a colorant dispersion, a polytetrafluoroethylene dispersion, and an organo metallic complexing component.

Disclosed in copending application U.S. Ser. No. 10/260,377, filed Sep. 27, 2002, entitled Toner Processes, the disclosure of which is totally incorporated herein by reference, is a process comprising heating a sulfonated polyester resin latex and a colorant below about the glass transition temperature (Tg) of the sulfonated polyester resin, adding a metal stearate to the resulting slurry, and isolating the product, and wherein the heating generates an alkyl carboxylate metal salt component ionically attached to the surface of the product.

Disclosed in copending application U.S. Ser. No. 10/446,015, filed May 27, 2003, entitled Toner Processes, the disclosure of which is totally incorporated herein by reference, is a toner process comprising heating a mixture of a latex and a colorant, which heating is accomplished below about the glass transition temperature, Tg, of polymer contained in the latex, cooling; and subsequently adding a methacrylate polymer solution; adjusting the pH of the mixture resulting to permit the methacrylate polymer to precipitate on the mixture of latex and the colorant.

In U.S. Pat. No. 6,132,924, the disclosure of which is totally incorporated herein by reference, there is illustrated a process for the preparation of toner comprising mixing a colorant, a latex, and two coagulants, followed by aggregation and coalescence, and wherein one of the coagulants may be polyaluminum chloride.

Illustrated in U.S. Pat. No. 5,945,245, the disclosure of which is totally incorporated herein by reference, is a process for the preparation of toner compositions comprising:

(i) preparing an emulsion latex comprised of sodio sulfonated polyester resin particles of from about 5 to about 500 nanometers in size diameter by heating the resin in water at a temperature of from about 65° C. to about 90° C.;

(ii) preparing a pigment dispersion in water by dispersing in water from about 10 to about 25 weight percent of sodio sulfonated polyester, and from about 1 to about 5 weight percent of pigment;

(iii) adding the pigment dispersion to a latex mixture comprised of sulfonated polyester resin particles in water with shearing, followed by the addition of an alkali halide in water until aggregation results, as indicated by an increase in the latex viscosity of from about 2 centipoise to about 100 centipoise;

(iv) heating the resulting mixture at a temperature of from about 45° C. to about 55° C. thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying.

In embodiments of the present invention there may be selected the appropriate components, and processes of the above copending applications and patents.

BACKGROUND

Disclosed herein is a toner process, and more specifically, a chemical toner processes which involves the aggregation and fusion of latex, colorant like pigment or dye, metal oxide, or where the metal oxide is added subsequent to aggregation and fusion with the colorant, and which oxide is, for example, commercially available as alumina particles, and additive particles.

More specifically, in embodiments illustrated herein are toner processes wherein there results a toner with a positive charge, triboelectric charge stability to a variety of environmental conditions, excellent developer aging characteristics, reduced excessive negative C-zone charge to thereby provide excellent toner relative humidity (RH) sensitivity, excellent flowing toners and toners free or substantially free of undesirable clumping.

The toners generated with the processes disclosed can be selected for copying and printing processes, including high speed highlight color systems, trilevel color xerography, color processes, and for a number of known imaging processes, and which toners can provide, for example, high quality colored images, including excellent developed custom color images with excellent image resolution, acceptable signal-to-noise ratio, and image uniformity. Also, the toners obtained with the processes illustrated herein can be selected for digital imaging systems and processes.

REFERENCES

In imaging systems, especially color systems, small sized toners of, for example, from about 2 to about 8 microns can be of value for the achievement of high image quality for process color applications. It is also important to have a low image pile height to eliminate, or minimize image feel and avoid paper curling after fusing. Paper curling can be particularly pronounced in xerographic color processes primarily because of the presence of relatively high toner coverage as a result of the application of three to four color toners. During fusing, moisture escapes from the paper due to high fusing temperatures of from about 120° C. to about 200° C. In the situation wherein only one layer of toner is selected, such as in one-color black or highlight color xerographic applications, the amount of moisture driven off during fusing can be reabsorbed by the paper, and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes featured herein.

Also, it may be useful to select certain toner particle sizes, such as from about 2 to about 12 microns, with a high colorant, especially pigment loading, such as from about 4 to about 17 percent by weight of toner, so that the mass of toner necessary for attaining the required optical density and color gamut can be significantly reduced to eliminate or minimize paper curl. Lower toner mass also ensures the achievement of image uniformity. However, higher pigment loadings often adversely affect the charging behavior of toners. For example, the charge levels may be too low for proper toner development or the charge distributions may be too wide and toners of wrong charge polarity may be present. Furthermore, higher pigment loadings may also result in the sensitivity of charging behavior to charges in environmental conditions, such as temperature and humidity. Toners prepared in accordance with the processes featured herein minimize, or avoid a number of these disadvantages.

There is illustrated in U.S. Pat. No. 4,996,127, the disclosure of which is totally incorporated herein by reference, a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, the disclosure of which is totally incorporated herein by reference, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. In U.S. Pat. No. 4,797,339, the disclosure of which is totally incorporated herein by reference, there is disclosed a process for the preparation of toners by resin emulsion polymerization wherein similar to the '127 patent certain polar resins are selected; and in U.S. Pat. No. 4,558,108, the disclosure of which is totally incorporated herein by reference, there is disclosed a process for the preparation of a copolymer of styrene and butadiene by specific suspension polymerization.

Polyester based chemical toners substantially free of encapsulation are also known, reference U.S. Pat. No. 5,593,807, the disclosure of which is totally incorporated herein by reference, wherein there is disclosed a process for the preparation of a toner comprised of a sodio sulfonated polyester resin and pigment, and wherein the aggregation and coalescence of resin particles is mediated with an alkali halide. Other U.S. patents that may be of interest, the disclosures of which are totally incorporated herein by reference, are U.S. Pat. Nos. 5,853,944; 5,843,614; 5,840,462; 5,604,076; 5,648,193; 5,658,704; and 5,660,965.

In U.S. Pat. No. 4,837,100, the disclosure of which is totally incorporated herein by reference, there is illustrated, for example, an electrophotographic developer comprising a carrier, toner particles positively chargeable by friction with the carrier, fine particles of hydrophilic alumina, and fine particles of one of tin oxide, hydrophobic silica and titanium dioxide, and wherein the hydrophilic alumina fine particles are present in an amount of from about 0.1 to about 3 percent by weight based on the weight of toner particles. The alumina particles of this patent can be selected for the toners and processes featured herein in embodiments thereof.

Emulsion/aggregation/coalescence processes for the preparation of toners are illustrated in a number of Xerox Corporation patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,858,601, and 5,977,210. The appropriate components and processes of the above Xerox Corporation patents can be selected for the processes featured herein in embodiments thereof.

With respect to the references, only a part thereof has been selected and this part may or may not be fully representative of the teachings or disclosures.

SUMMARY

It is a feature of the present disclosure to provide toner processes with many of the advantages illustrated herein.

In another feature of the present disclosure there are provided simple and economical processes for the preparation of black and colored toner compositions with excellent colorant dispersions, thus enabling the achievement of excellent color print quality; and a simple and economical chemical process for the preparation of toner compositions.

Additionally, another feature of the present disclosure resides in a process capable of delivering differing toner morphology particles, such as spherically shaped toner particles.

Moreover, in another feature of the present disclosure there are provided emulsion, aggregation, coalescence processes wherein, for example, the toner obtained has incorporated during the process, that is, for example, prior to or subsequent to aggregation and coalescence, alumina particles.

Aspects disclosed herein and of the present invention in embodiments relate to a process comprising adding a polymer to heated water; adding a colorant dispersion, and then subsequently adding an aggregating agent; heating the resulting mixture above about the polymer glass transition temperature thereby causing aggregation and coalescence, optionally followed by cooling and drying, and subsequently adding alumina particles, and wherein there results particles comprised of polymer, colorant, aggregating agent, and alumina, and optionally wherein the alumina is present on the surface of the particles resulting; a toner process comprising heating a mixture of a latex and a colorant dispersion in the presence of an aggregating agent, and subsequently adding in an amount of at least about 4 weight percent alumina particles, and optionally which particles primarily function as a charge enhancing additive; a toner process comprising heating a mixture of a latex aggregating agent and a colorant in the presence of water, which water is at a temperature of above about 40° C. and less than about 100° C., which heating is accomplished below about the glass transition temperature, Tg, of polymer contained in the latex, followed by a second heating above about the Tg polymer temperature, and subsequently adding in an amount of at least about 4 weight percent alumina particles; a process wherein the latex is a latex emulsion comprised of resin, water, and an ionic surfactant, and wherein the colorant mixture is a dispersion containing a colorant, water, and an ionic surfactant; a process wherein there is selected for the ionic surfactant a nonionic surfactant; a process wherein the alumina particles are selected in an amount of from about 4 to about 10 percent by weight of the toner components; a process wherein the alumina particles are selected in an amount of at least 4 percent by weight; a process wherein each of the surfactants is selected in an amount of from about 1 to about 10 weight percent based on the toner component amounts; a process wherein there can optionally be added to the latex colorant mixture a second latex, and which latex is comprised of submicron resin particles suspended in an aqueous phase containing an ionic surfactant, and wherein the second latex is optionally selected in an amount of from about 10 to about 40 percent by weight of the initial latex; a process wherein the temperature below about the latex resin Tg is from about 40° C. to about 60° C., thereby resulting in toner aggregates, and the temperature above about the latex resin Tg is from about 75° C. to about 97° C.; a process wherein the temperature at which the aggregation is accomplished controls the size of the aggregates, and wherein the toner isolated is of from about 2 to about 15 microns in volume average diameter; a process wherein the colorant is a pigment; a process wherein the latex contains a polyester, such as polyester SPE2, available from Hercules Chemical; a toner and processes thereof wherein the resin is a polyester of the formula

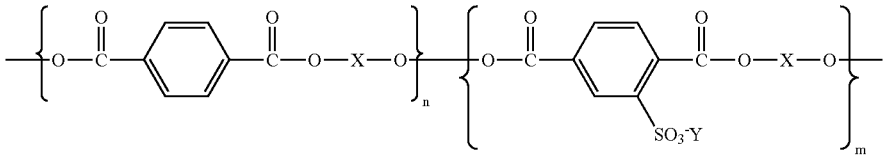

wherein Y is an alkali metal, X is a glycol, and n and m each represent the number of segments; a toner wherein the polyester is a sodiosulfonated polyester; a toner wherein the polyester is present in an amount of from about 80 to about 98 percent by weight of the toner, the colorant is present in an amount of from about 2 to about 20 weight percent of the toner, the alumina is present in an amount of about 5 to about 12 percent by weight, and wherein the total of all the toner components is about 100 percent; a toner wherein the polyester resin contains from about 0.1 to about 5 weight percent of sulfonated groups; a toner wherein the alumina primarily functions to enhance the toner triboelectric charge and reduce the toner relative humidity sensitivity; a toner wherein the polyester is a sodiosulfonated polyester; a process for the preparation of toner comprising mixing alumina particles with a latex and a colorant mixture comprised of colorant, and an ionic surfactant, heating the resulting mixture below about the glass transition temperature (Tg) of the latex resin, heating above about the Tg of the latex resin; or alternatively adding alumina particles subsequent to the formation of toner, which particles can function as a charge enhancing additive, and optionally isolating the toner, and wherein the alumina resides on the surface of the toner; a process wherein the latex is a latex emulsion comprised of resin, water, and an ionic surfactant, and wherein the colorant mixture is a dispersion containing a pigment, water, and an ionic surfactant; a process wherein there is selected for the ionic surfactant a nonionic surfactant; a process wherein each of the surfactants is selected in an amount of from about 3 to about 7 weight percent based on the toner component amounts; a process wherein there is added to the mixture or resin latex and colorant a second latex, and which latex is comprised resin particles suspended in an aqueous phase containing an ionic surfactant, and wherein the second latex is selected in an amount of from about 12 to about 25 percent by weight of the initial latex; a process wherein the temperature below about the latex resin Tg is from about 40° C. to about 65° C., thereby resulting in toner aggregates, and the temperature above about the latex resin Tg is from about 77° C. to about 95° C.; a process wherein the temperature at which the aggregation is accomplished controls the size of the aggregates, and wherein the toner isolated is from about 2 to about 25 microns in volume average diameter; a process wherein the latex resin is selected from the group consisting of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly (propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid); a process wherein the colorant is carbon black, cyan, yellow, magenta, or mixtures thereof, and the toner isolated is from about 2 to about 25 microns in volume average diameter, and the particle size distribution thereof is optionally from about 1.15 to about 1.30, and wherein there is optionally added to the surface of the formed toner metal salts, metal salts of fatty acids, silicas, metal oxides, or mixtures thereof, each in an amount of from about 0.1 to about 10 weight percent of the obtained toner; a process wherein the colorant is a colorant dispersion comprised of (i) a colorant, water, an ionic surfactant, a nonionic surfactant, or mixtures of an ionic surfactant, and a nonionic surfactant; the latex is a latex emulsion; and wherein (ii) the colorant dispersion is blended with the latex emulsion comprised of resin, a nonionic surfactant and an ionic surfactant, and optionally adding a wax dispersion comprised of, for example, submicron particles in the diameter size range of from about 0.1 to about 0.4 micron dispersed in an ionic surfactant of the same charge polarity as that of the ionic surfactant in the colorant dispersion or latex emulsion;

(iii) heating the resulting mixture below about, or about equal to the glass transition temperature (Tg) of the latex resin to form toner sized aggregates;

(iv) heating the resulting aggregate suspension above about the Tg of the latex resin; adding the alumina particles and isolating the toner, which toner contains the alumina particles on the surface thereof; a process for the preparation of toner comprising (i) providing or generating a latex emulsion of resin, water, and an ionic surfactant, and providing or generating a colorant dispersion containing a colorant, water, an ionic surfactant, or a nonionic surfactant;

(ii) optionally providing or generating a wax dispersion containing an anionic surfactant similarly charged to that of the latex surfactant emulsion;

(iii) blending (ii) with the colorant dispersion;

(iv) heating the resulting mixture below the glass transition temperature (Tg) of the latex resin;

(v) heating (vii) above about the Tg of the latex resin;

(vi) followed by the addition of alumina particles in an amount of from about 4 to about 7 weight percent;

(vii) retaining the mixture (vi) at a temperature of from about 70° C. to about 95° C. for about 3 to about 10 hours;

(viii) washing the resulting toner slurry; and (ix) isolating the toner; a process wherein the added latex contains the same resin as the initial latex of (i), or wherein the added latex contains a dissimilar resin than that of the initial latex resin (i); a process wherein aggregation of latex resin and colorant is accomplished by heating at a temperature below the glass transition temperature of the resin or polymer contained in the latex, and coalescence is accomplished by heating at a temperature of above the glass transition temperature of the polymer contained in the latex (i) to enable fusion or coalescence of colorant and latex resin, followed by the mixing of the composition resulting with alumina particles; a process wherein the aggregation temperature is from about 45° C. to about 55° C., and the coalescence temperature is from about 75° C. to about 97° C.; a process for preparing toner particles comprising (i) providing or generating a latex emulsion of resin, water, and an anionic surfactant; a process wherein the latex emulsion comprises submicron resin particles in the size range of about 100 to about 500 nanometers, and more specifically, in the size range of about 150 to about 400 nanometers in water and an ionic surfactant, and more specifically, an anionic surfactant; the colorant dispersion comprises submicron pigment particles of about 50 to about 250 nanometers, and more specifically, of about 80 to about 200 nanometers in size diameter; a toner process wherein the cationic surfactant comprises, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, and which coagulant surfactant component is selected in an amount of, for example, from about 0.01 to about 10 percent by weight of toner; a process wherein there is added during or subsequent to (v) a second latex, and which latex is comprised of submicron resin particles suspended in an aqueous phase containing an ionic surfactant, and wherein the second latex is optionally selected in an amount of about 15 to about 35 percent by weight of the initial latex; a process wherein the second latex (vi) is added and enables formation of a coating on the resulting toner aggregates of (v), and wherein the thickness of the formed coating is from about 0.1 to about 1 micron; a process wherein the aggregation temperature is from about 50° C. to about 60° C., and the coalescence temperature is from about 80° C. to about 95° C.; a process wherein the latex (i) or added latex contains a resin or polymer selected from the group consisting of a number of suitable know resins, or polymers, and more specifically, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), a polyester, and poly(styrene-butyl acrylate-acrylononitrile-acrylic acid); a process wherein the toner colorant is carbon black, red, green, cyan, yellow, magenta, or mixtures thereof, and the toner isolated is from about 1 to about 25 microns in volume average diameter, and the particle size distribution thereof is optionally from about 1.15 to about 1.30; and wherein there is added to the surface of the formed toner metal salts, metal salts of fatty acids, silicas, metal oxides, or mixtures thereof, each in an amount of from about 1 to about 3 weight percent of the obtained toner.

Examples of resins, such as polyester resins are as indicated herein and in the appropriate U.S. patent applications and patents recited herein, and more specifically, examples of a number of polyesters that can be selected are copoly(1,2-propylene-dipropylene-5-sulfoisophthalate)-copoly(1,2-propylene-dipropylene terephthalate), copoly(1,2-propylene-diethylene-5-sulfoisophthalate)-copoly(1,2-propylene-diethylene terephthalate), copoly(propylene-5-sulfoisophthalate)-copoly(1,2-propylene terephthalate), copoly(1,3-butylene-5-sulfoisophthalate)-copoly(1,3-butylene terephthalate), copoly(butylenesulfoisophthalate)-copoly(1,3-butylene terephthalate), and the like.

The alumina particles selected are commercially available from, for example, Alfa Aesar located in Massachusetts, USA, and more specifically, there can be selected a hydrophilic alumina such as Aluminum Oxide C (a product of Nippon Aerosil Co., Ltd.). The hydrophilicity of the alumina is usually considered sufficient when the alumina can be dispersed in water. The hydrophilic alumina particles possess an average particle size diameter of, for example, from about 20 to about 150 nanometers, and more specifically, from about 30 to about 50 nanometers. Various suitable effective amounts of the alumina particles can be selected, and more specifically, at least about 3 weight percent of alumina particles are selected, such as, for example, from about 3 to about 10 weight percent, and more specifically, from about 4 to about 5 weight percent, and which particles function primarily as a toner charge enhancing additive.

Specific examples of aluminas that can be selected include $Al_2O_3$ dry powder, with a specific gravity of from about 3.4 to about 4 grams/$cm^3$; a diameter of, for example, from about 20 nanometers to about 3 microns and available from Cabot Corporation (Massachusetts), Degussa AG (Germany), Bayer AG (Germany), H.C. Starck, Inc. (USA); 20 nanometers of alumina primary particles contained in an aqueous dispersion and available from Cabot as CAB-O-SPERSE® PG003, other known aluminas, and the like.

Various known colorants, especially pigments, present in the toner in an effective amount of, for example, from about 1 to about 65, and more specifically, from about 2 to about 35 percent by weight of the toner, and yet more specifically, in an amount of from about 1 to about 15 weight percent, and wherein the total of all toner components is about 100 percent, include carbon black like REGAL 330®; magnetites such as Mobay magnetites M08029™, MO8060™; and the like. As colored pigments, there can be selected known cyan, magenta, yellow, red, green, brown, blue or mixtures thereof. Specific examples of colorants, especially pigments, include phthalocyanine HELIOGEN BLUE L6900™, D6840™, D7080™, D7020™, Cyan 15:3, Magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of specific cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative specific examples of yellows that may be selected are Diarylide Yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan, magenta, yellow components may also be selected as pigments. The colorants, such as pigments, selected can be flushed pigments as indicated herein.

More specifically, colorant examples include Pigment Blue 15:3 having a Color Index Constitution Number of 74160, Magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like. Colorants include pigments, dyes, mixtures of pigments, mixtures of dyes, mixtures of dyes and pigments, and the like, and preferably pigments.

Dry powder additives that can be added or blended onto the surface of the toner compositions after, for example, washing or drying include, for example, metal salts, metal salts of fatty acids, colloidal silicas, metal oxides like titanium, siloxanes, tin and the like, mixtures thereof, which additives are each present in an amount of from about 0.1 to about 2 weight percent or other effective amounts, reference U.S. Pat. Nos. 3,590,000; 3,720,617; 3,655,374 and 3,983,045, the disclosures of which are totally incorporated herein by reference. Preferred additives include zinc stearate and flow aids, such as fumed silicas like AEROSIL R972® available from Degussa, or silicas available from Cabot Corporation or Degussa Chemicals, the coated silicas of U.S. Pat. No. 6,004,714 and U.S. Pat. No. 6,190,815, the disclosures of which are totally incorporated herein by reference, and the like.

Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

In embodiments thereof illustrative examples of resin, polymer or polymers disclosed herein in the latex (i) or added latex include known polymers such as methacrylates, acrylates, polyesters, polybutadienes, and other suitable polymers as illustrated herein for example. The latex polymer, or resin is generally present in the toner compositions in various suitable amounts, such as from about 75 to about 98 weight percent, or from about 80 to about 95 weight percent of the toner or of the solids, and the latex size can be, for example, from about 0.05 micron to about 0.5 micron in volume average diameter as measured by the Brookhaven nanosize particle analyzer. Other sizes and effective amounts of latex polymer may be selected in embodiments. The total of all toner components, such as resin, calcium stearate, and colorant, is about 100 percent, or about 100 parts.

The polymer selected for the process disclosed can be prepared by emulsion polymerization methods, and the monomers utilized in such processes include, for example, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes.

Examples of waxes that can be selected for the processes and toners illustrated herein include polypropylenes and polyethylenes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. The commercially available polyethylenes selected possess, it is believed, a molecular weight $M_w$ of from about 1,000 to about 3,000, while the commercially available polypropylenes are believed to have a molecular weight of from about 4,000 to about 7,000. Examples of functionalized waxes include, such as amines, amides, for example AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc., mixed fluorinated amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, chlorinated polypropylenes and polyethylenes available from Allied Chemical, Petrolite Corporation and SC Johnson Wax.

Examples of initiators utilized for the latex preparation include water soluble initiators, such as ammonium and potassium persulfates, in suitable amounts, such as from about 0.1 to about 8 percent, and more specifically, from about 0.2 to about 5 percent (weight percent). Examples of organic soluble initiators include Vazo peroxides, such as VAZO 64™, 2-methyl 2-2'-azobis propanenitrile, and VAZO 88™, 2-2'-azobis isobutyramide dehydrate in a suitable amount, such as in the range of from about 0.1 to about 8 percent. Examples of chain transfer agents include dodecanethiol, octanethiol, carbon tetrabromide, and the like in various suitable amounts, such as in an amount of from about 0.1 to about 10 percent, and more specifically, from about 0.2 to about 5 percent by weight of monomer.

Surfactants for the preparation of latexes and colorant dispersions can be ionic or nonionic surfactants selected in effective amounts of, for example, from about 0.01 to about 15, or from about 0.01 to about 5 weight percent of the reaction mixture. Anionic surfactants include sodium dodecylsulfate (SDS), sodium dodecylbenzene sulfonate, sodium dodecyinaphthalene sulfate, dialkyl benzenealkyl, sulfates and sulfonates, abitic acid, available from Aldrich, NEOGEN R™, NEOGEN SC™ obtained from Kao, and the like. Examples of cationic surfactants are dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOLM (benzalkonium chloride) available from Kao Chemicals, and the like, selected in effective amounts of, for example, from about 0.01 percent to about 10 percent by weight. The molar ratio of the cationic surfactant used for flocculation to the anionic surfactant used in the latex preparation is, for example, from about 0.5 to about 4.

Illustrative examples of aggregating components or agents include zinc stearate; alkali earth metal or transition metal salts; alkali (II) salts, such as beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and the like. Examples of transition metal salts or anions include acetates, acetoacetates, sulfates of vanadium, niobium, tantalum, chromium, molybdenum, tungsten, manganese, iron, ruthenium, cobalt, nickel, copper, zinc, cadmium, silver or aluminum salts, such as aluminum acetate, aluminum polyaluminum chloride, aluminum halides, mixtures thereof, and the like. The amount of aggregating agent selected can vary, and is, for example, from about 0.1 to about 10, and more specifically from about 2 to about 5 weight percent by weight of toner or by weight of water.

Examples of nonionic surfactants selected in various suitable amounts, such as about 0.1 to about 5 weight percent, are polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™, can be selected.

The following Examples are presented.

EXAMPLE I

A polyester cyan toner was prepared by following the process as illustrated in U.S. Pat. No. 6,395,445, the disclosure of which is totally incorporated herein by reference.

A sulfonated polyester resin and emulsion thereof is prepared as follows. Dimethylterephthalate (715 grams), sodium dimethyl 5-sulfoisophthalate (95.8 grams), propanediol (526 grams), diethylene glycol (48 grams), dipropylene glycol (247.1 grams), and butyltin hydroxide catalyst (1.5 grams) are charged to a 2 liter Hoppes polycondensation reactor, equipped with a heating jacket, mechanical stirrer with anchor, thermowell, reflux and take-off condenser. The mixture is heated to 190° C., and the temperature is allowed to slowly increase to about 200° C. to about 202° C. while the methanol byproduct is collected in a distillation receiver. The temperature is then raised to about 210° C. as the pressure is reduced from atmospheric to about 8 millimeters Hg over a period of about 4.5 hours. During this time, excess glycol is collected in the distilling receiver. The product is discharged through a bottom drain valve to result in random copolymers thereof of 44 percent/5.9 percent/32.4 percent/3 percent/14.8 percent of dimethylterephthalate/sodium dimethyl 5-sulfoisophthalate/propanediol/diethylene glycol/dipropylene glycol. 168 Grams of the above polyester resin are then added to 1,232 grams of deionized water at 92° C. in a 20 gallon reactor with stirring for 2 hours to provide an emulsion of from about 10 to about 25 weight percent of sulfonated polyester particles in water. The diameter particle size of the resin in the emulsion is typically 22 nanometers as measured by a NiComp sizer.

In a stainless steel 2 liter Buchi reactor equipped with two stirring blades (P4/45°), 2 baffles, and with heating supplied by an outside bath to the jacket of the reactor are added 1,400 grams of the above polyester emulsion, and 14.22 grams of FLEXIVERSE® blue 15:3 color pigment dispersion available from Sun Chemical Company. A solution of 5 percent zinc acetate (aggregating agent) in deionized water is prepared by dissolving zinc acetate at room temperature (22° C. to 25° C.) in a beaker with magnetic stirring. This solution is added to a reservoir that is placed onto a balance and connected to a pump capable of accurately dispensing the zinc acetate solution between 0.0 and 9.9 ml/minute. The amount of zinc acetate selected in this Example for the aggregation is 10 percent of the weight of resin in the emulsion. The emulsion/dispersion is heated to 56° C., and the stirring speed is adjusted to 350 rpm by a tachometer. To initiate the aggregation, the pump to the zinc acetate solution is started at 9.9 ml/minute. The amount of zinc acetate in the aggregation is measured by the weight loss on the balance. When 60 percent of the total zinc acetate is added (205 grams of 5 percent solution), the pump addition rate is reduced to 1.1 ml/minute, and the addition is continued until the amount of zinc acetate equals 10 percent of the resin in the emulsion (335 grams of 5 percent solution). Samples, in amounts of 1 gram, are taken during and tested on a Coulter Counter for particle size and particle size distribution. When the particle size is 6 μm and the geometric size distribution (GSD) less than 1.2, the aggregation is stopped by lowering the temperature in the reactor to room temperature. The particles resulting are then discharged and screened through 150 and 38 μm sieves to remove coarse material with particle diameter sizes of about 40 to about 500 micrometers, and then the particles are collected by filtration on a 5 μm polypropylene filter cloth. The particles are then rinsed and washed 2 times. The filtrate conductivity is 23.4 μS. The toner particles are dried in a vacuum oven for 64 hours at room temperature. Fouled material is scraped from the reactor interior. The coarse and fouled material is then also dried and weighed to determine the mass balance. The resulting toner is comprised of the above sulfonated polyester resin, about 85 weight percent; 9 weight percent Carnauba wax; and 6 weight percent of the above cyan Blue 15:3.

A solution-coated carrier 35 μm in diameter and comprising a ferrite core (Powdertech Corporation, Japan), and a coating of 2.44 percent (14/66/20 PFEMA/TBMA/MMA) perfluoroethyl methacrylate/tertiarybutyl methacrylate/methyl methacrylate resin, 0.26 percent carbon black and 0.3 percent EPOSTAR S Melamine beads is used to prepare experimental developers: 10 Grams of the aforementioned carrier particles are mixed with 0.5 gram of the above prepared toner in a 60 milliliter glass bottle and conditioned for about 16 to about 18 hours in A- or C-zone environmental chambers (85 percent RH, 28° C.; 15 percent RH, 10° C., respectively). After conditioning, developer is charged in a Turbula mixer for 60 minutes. Triboelectric charge was measured by obtaining toner traces on paper substrates in a charge spectrograph and measuring the deflection of the toner trace from the zero-field dot position. Typically, deflection to the right is for negative charge, left for positive charge.

The toner exhibited a negative charge of −19 millimeters (i.e., millimeters of average deflection in the charge spectrograph under an electric field of 100 volts per centimeter from a zero-field dot position) in C-zone and −0.5 millimeter in A-zone at very high RH sensitivity (C/A charge ratio of 38).

EXAMPLE II

The toner of Example I is blended with 4 weight percent of alumina nano-powder particles available from Alfa Aesar (MA, USA), catalog number 10459, by using a 1 liter SK-M toner mill.

The toner triboelectric charge is measured with the same carrier as in Example I and using the method of Example I. The toner charge is positive, +5 millimeters in A-zone and +11 millimeters in C-zone (C/A ratio 2.2).

Development experiments are conducted in a Xerox Corporation DC1250 printer. 450 Grams of developer at a toner/carrier ratio of 5 percent are charged in a Turbula mixer for 10 minutes and placed in the DC1250 black developer housing. Then the toner/carrier ratio is increased to 7 percent and 9 percent. Test images are obtained on the machine photoreceptor under the CAD (charge area development) conditions where the high potential on the charged photoreceptor (−650 volts) corresponds to toned image area, and the low potential on laser-discharged photoreceptor (−400 volts) corresponds to white area. The magnetic roller bias is varied between −650 V and −400.

DMA (developed toner mass per unit area) is measured by developing a solid area toner patch with known area and weighing the amount of developed toner by collecting it on a MILIPORE® filter attached to a vacuum pump. The level of background development is measured by tape transfer from the white area and counting toner particles per square mm. Visible background is usually observed with about 100 to about 600 particles per square millimeter.

TABLE 1

| TC | Q/D, MM | VBIAS | DMA ($MG/CM^2$) | BKG (PARTICLES PER $MM^2$) |
|---|---|---|---|---|
| 5 percent | 3.21 | −450 | 0.272 | |
| 5 percent | 3.21 | −475 | 0.046 | 80 |
| 5 percent | 3.21 | −500 | | |
| 5 percent | 3.21 | −450 | 0.130 | 40 |
| 7 percent | 2.65 | −450 | 0.206 | 40 |
| 7 percent | 2.65 | −475 | 0.170 | 84 |
| 7 percent | 2.65 | −425 | 0.264 | 20 |
| 9 percent | 2.50 | −425 | 0.270 | |
| 9 percent | 2.50 | −425 | 0.284 | 40 |
| Developer aged off-line for 60 minutes | | | | |
| 9 percent (aged) | 2.50 | −425 | 0.238 | 48 |

Table 1 illustrates DMA and background at different TC (toner concentration) and development bias. Typically, a DMA of at least 0.2 $mg/cm^2$ is excellent to obtain a reasonable solid area image. The data in Table 1 indicates that the positive-charged toner of this Example II can be developed under the CAD conditions to a reasonable DMA (>0.2 $mg/cm^2$) with a low background in a broad range of toner concentrations.

After aging the developer in the no toner throughput regime for 60 minutes (an equivalent of printing 3,000 blank images) under a typical stress regime, no change in triboelectric charge (q/d) and very little change in DMA and background occurred indicating that the Example II toner is stable to mechanical aging.

EXAMPLE III

The developer in this Example contains the toner of Example II and carrier prepared by powder coating a 35 μm diameter Powdertech ferrite core with a 0.8 weight percent coating polymer blend comprising 75 percent SLS PMMA illustrated in U.S. Pat. No. 6,355,391, the disclosure of which is totally incorporated herein by reference, 9 percent VULCAN® carbon black (Cabot, USA), 10 percent EPOSTAR™ S melamine-formaldehyde resin powder, particle size of about 100 to about 300 nanometers (Nippon Shokubai, Japan) and 6 percent KYNAR® (DuPont, USA).

TABLE 2

| ALUMINA CONTENT | Q/D, MM |
|---|---|
| 0.50 percent | −30.36 |
| 1 percent | −17.25 |

TABLE 2-continued

| ALUMINA CONTENT | Q/D, MM |
|---|---|
| 2 percent | 1.53 |
| 4 percent | 12.31 |

Table 2 indicates, for example, how developer charge changes with alumina content; 2 percent alumina loading enables a positive charge, and 4 percent of alumina permits an excellent toner positive charge level.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A process comprising adding a polymer to heated water; adding a colorant dispersion, and then subsequently adding an aggregating agent; heating the resulting mixture above about the polymer glass transition temperature thereby causing aggregation and coalescence, optionally followed by cooling and drying, and subsequently adding alumina particles, and wherein there results particles comprised of said polymer, said colorant, said aggregating agent, and said alumina, and optionally wherein said alumina is present on the surface of said particles.

2. A process in accordance with claim 1 wherein said polymer is a polyester.

3. A process in accordance with claim 1 wherein said polymer is a sulfonated polyester.

4. A process in accordance with claim 1 wherein said polymer is the polyester

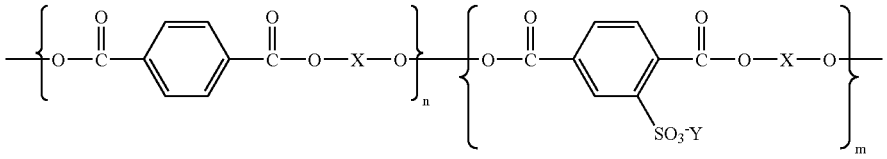

wherein Y is an alkali metal, X is a glycol, and n and m each represent the number of segments.

5. A process in accordance with claim 4 wherein said alkali metal is potassium.

6. A process in accordance with claim 4 wherein said alkali metal is sodium.

7. A processin accordance with claim 4 wherein said glycol is an alkylene glycol.

8. A process in accordance with claim 7 wherein said alkylene contains from about 2 to about 18 carbon atoms.

9. A process in accordance with claim 4 wherein said m and said n are each a number of from about 10 to about 275.

10. A process in accordance with claim 4 wherein said m and said n are each a number of from about 75 to about 150.

11. A process in accordance with claim 4 wherein the sulfonated polyester (i) is a polyester of poly(1,2-propylene-sodio 5-sulfoisophthalate), poly(neopentylene-sodio 5-sulfoisophthalate), poly(diethylene-sodio 5-sulfo isophthalate), copoly-(1,2-propylene-sodio 5-sulfoisophthalate)-copoly-(1,2-propylene-terephthalatephthalate), copoly-(1,2-propylene-diethylenesodio 5-sulfoisophthalate)-copoly-(1,2-propylene-diethylene-terephthalatephthalate), copoly-(ethylene-neopentylene-sodio 5-sulfoisophthalate)-copoly-(ethylene-neopentylene-terephthalate-phthalate), or copoly-(propoxylated bisphenol A)-copoly-(propoxylated bisphenol A-sodio 5-sulfoisophthalate).

12. A process in accordance with claim 4 wherein said polyester resin is poly(1 ,2-propylene-sodio 5-sulfoisophthalate).

13. A process in accordance with claim 4 wherein said polyester resin is polyneopentylene-sodio 5-sulfoisophthalate polyester.

14. A process in accordance with claim 1 wherein said alumina particles are present in an amount of equal to or about at least 4 weight percent.

15. A process in accordance with claim 1 wherein said alumina particles are present in an amount of from about 3 to about 10 weight percent.

16. A process in accordance with claim 1 wherein said alumina particles are present in an amount of from about 5 to about 10 weight percent.

17. A process in accordance with claim 1 wherein said alumina particles are present in an amount of from about 5 to about 7, weight percent.

18. A process in accordance with claim 1 wherein said alumina particles are present in an amount of from about 4 to about 5 weight percent.

19. A process in accordance with claim 1 wherein said heating above said Tg is from about 70° C. to about 95° C., and said polymer is a nonpolyester.

20. A process in accordance with claim 1 wherein said polymer is present in an amount of from about 80 to about 98 percent by weight, and said colorant is present in an amount of from about 2 to about 20 weight percent of the toner.

21. A process in accordance with claim 1 wherein said polymer is initially heated at from about 40° C. to about 60° C., and said heating above about said polymer Tg is from about 65° C. to about 75° C., and said polymer is a nonpolyester.

22. A process in accordance with claim 1 wherein said particles resulting are isolated, and said alumina particles are present on the surface of said particles, and wherein said particles are toner particles.

23. A process in accordance with claim 1 wherein the colorant is a pigment.

24. A process in accordance with claim 1 wherein said polymer is selected from the group consisting of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly( propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid).

25. A process in accordance with claim 1 wherein said colorant is carbon black, cyan, yellow, magenta, or mixtures thereof, and the product isolated is a toner of from about 2 to about 25 microns in volume average diameter, and optionally wherein there is added to the surface of the formed toner metal salts, metal salts of fatty acids, silicas, metal oxides, or mixtures thereof, each in an amount of from about 0.1 to about 10 weight percent of the obtained toner.

26. A process in accordance with claim 1 wherein said aggregating agent is an alkali earth metal, a transition metal salt, or mixtures thereof.

27. A process in accordance with claim 1 wherein said aggregating agent is beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, or barium iodide.

28. A process in accordance with claim 1 wherein said aggregating agent is a transition metal salt of acetates, acetoacetates, sulfates of vanadium, niobium, tantalum, chromium, molybdenum, tungsten, manganese, iron, ruthenium, cobalt, nickel, copper, zinc, cadmium, silver salts, aluminum salts optionally of aluminum acetate, aluminum polyaluminum chloride, aluminum halides, or mixtures thereof,and optionally wherein the concentration thereof is of from about 0.1 to about 5 weight percent by weight of water.

29. A process in accordance with claim 1 wherein said aggregating agent is zinc acetate.

30. A process in accordance with claim 1 wherein said aggregating agent is present in an amount of from about 0.1 to about 10 weight percent.

31. A process in accordance with claim 1 wherein said aggregating agent is present in an amount of from about 1 to about 5 weight percent.

32. A process in accordance with claim 1 wherein said heating above said Tg is from about 75° C. to about 90° C., and said polymer is a nonpolyester.

33. A toner process comprising heating a mixture of a latex aggregating agent and a colorant in the presence of water, which water is at a temperature of above about 40° C. and less than about 100° C., which heating is accomplished below about the glass transition temperature, Tg, of polymer contained in the latex, followed by a second heating above about the Tg polymer temperature, and subsequently adding in an amount of at least about 4 weight percent alumina particles.

* * * * *